United States Patent [19]

Karra et al.

[11] Patent Number: 5,042,732

[45] Date of Patent: Aug. 27, 1991

[54] APPARATUS FOR HIGH-YIELD LOW-WASTE CONICAL CRUSHING

[75] Inventors: Vijia K. Karra, Franklin; Anthony J. Magerowski, Milwaukee, both of Wis.

[73] Assignee: Nordberg Inc., Milwaukee, Wis.

[21] Appl. No.: 531,026

[22] Filed: May 31, 1990

[51] Int. Cl.[5] ..... B02C 2/00

[52] U.S. Cl. ..... 241/207; 241/300

[58] Field of Search ..... 241/207-216, 241/300

[56] References Cited

U.S. PATENT DOCUMENTS

| | | | |
|---|---|---|---|
| 1,574,142 | 2/1926 | Weston . | |
| 1,748,102 | 2/1930 | Bernhard | 241/211 |
| 1,837,102 | 12/1931 | Bernhard | 241/211 |
| 2,066,281 | 12/1936 | Traylor, Jr. et al. . | |
| 2,079,882 | 5/1937 | Traylor, Jr. . | |
| 2,327,384 | 8/1943 | Annesley . | |
| 2,484,971 | 10/1949 | Traylor, Jr. . | |
| 3,666,188 | 5/1972 | Lippmann . | |

FOREIGN PATENT DOCUMENTS

| | | | |
|---|---|---|---|
| 120317 | 9/1945 | Australia | 241/209 |
| 692791 | 5/1940 | Fed. Rep. of Germany | 241/212 |
| 501957 | 11/1954 | Italy | 241/209 |
| 8705828 | 10/1987 | PCT Int'l Appl. | 241/207 |
| 1151297 | 4/1985 | U.S.S.R. | 241/210 |
| 435959 | 10/1935 | United Kingdom | 241/209 |
| 2123314 | 2/1984 | United Kingdom . | |

OTHER PUBLICATIONS

Boliden Allis brochure, "The H-4000 Hydrocone: The Third-Generation Cone Crusher for Motor Powers Up to 220 Kw", Apr., 1989.

Krupp Industrie-Und Stahlbau brochure, "KUBRIA-Kegelbrecher Typ Esch", undated.

*Primary Examiner*—Mark Rosenbaum

*Attorney, Agent, or Firm*—Welsh & Katz, Ltd.

[57] ABSTRACT

A conical crusher designed for high yield, low waste crushing includes a head mantle with a crushing surface having a uniform radius of curvature and a bowl liner with a crushing surface having a uniform radius of curvature, the radius of curvature of the head mantle being distinct from the radius of curvature of the bowl liner.

6 Claims, 1 Drawing Sheet

LW
MW
LW'
MW'
66a
66
R1
R2
10
12
14
16
18
20
22
24
26
28
30
32
34
36
38
40
42
44
46
48
50
52
54
56
58
60
62
64
68
70
72
74
76
78
80
82
84
86
90
92
94

APPARATUS FOR HIGH-YIELD LOW-WASTE CONICAL CRUSHING

BACKGROUND OF THE INVENTION

The present invention relates to conical crushers designed for the comminution of rocks and/or other mineral materials, and specifically relates to the relative crushing surface configurations of a head mantle and a bowl liner of such a crusher.

Conical crushers are provided in a variety of operational modifications, but most such crushers include a fixed lower frame defining a space in which a conical head is caused to gyrate about a vertical axis, and a movable upper frame having a bowl with a bowl liner which defines a negative concave, the bowl and the head disposed relative to each other to define a crushing cavity. The head usually includes a head mantle which is replaceable, and the bowl liner is also replaceable. Feed material introduced at an upper end of the machine falls into the crushing cavity where it is comminuted by the action of the head mantle against the bowl liner.

In conventional crushers, the conical head mantle has an exterior crushing surface which is generally concave in cross-section, while an exterior crushing surface of the bowl liner is generally convex in cross-section. These working surfaces of the mantle and bowl liner often form a downwardly tapering crushing cavity which is generally V-shaped in cross-section. Such an arrangement is disclosed in U.S. Pat. No. 3,666,188. The width of this cavity at the crusher setting, or narrowest point between the bowl liner and the head, determines the maximum particle size in the crushed material, and the nip angle of the V-shaped cavity is important to the throughput or production of the machine. If the nip angle is too large, the resistance to downfeeding of larger particles will be unacceptably great, and moreover, these larger particles even show a tendency towards moving upwardly and blocking the crushing cavity.

Another design feature of conventional conical crushers is the creation of a parallel zone at the lower end of the crushing cavity which is defined by generally parallel opposing faces of the head mantle and bowl liner. The purpose of the parallel zone is to maximize the reduction of feed material by forcing the material to be comminuted between the head mantle and the bowl liner a minimum of one more time at the minimum crusher setting before the material is discharged from the crusher.

Although maximum reduction is desirable in mining applications, it is undesirable in the production of aggregate material for use as base material, concrete stone and asphalt fillers, due to the production of excessive amounts of fines and dust. These latter byproducts are considered waste material, for they have little, if any commercial value, are difficult to dispose of, and may be hazardous to health or to the environment. Users of conventional conical crushers for the production of aggregate have increasingly demanded increased yields of Number 8 stone (nominally ⅜ inch by 8 mesh crushed material) and a decrease in the amount of minus 200 mesh waste material.

Attempts have been made to alter the shape of the relative exterior crushing surfaces of the head mantle and the bowl liner to achieve certain specified product shapes and/or production volumes. U.K. published application No. 2,123,314 discloses opposing mantle and bowl liner surfaces configured so that the generally parallel zone between the upper portions of these components of the crushing cavity will remain constant as the position of the head is axially adjusted. However, the above-identified crusher, as well as the majority of conventional conical crushers, still retains the parallel zone at the lower end of the crusher cavity, where it is believed much of the waste material is generated.

Another design parameter which influences the shape of crushing cavities is that, through use, the configurations of the opposing crushing surfaces of the head mantle and bowl liner will erode. This erosion is usually accommodated for by adjusting the position of the bowl relative to the head; however, such erosion and adjustment of eroded crushing surfaces often changes the geometry of the original crushing cavity. Consequently, the shape of the crushed product may be changed, and/or the total volume of material produced by the crusher may be reduced.

Thus, an object of the present invention is to provide a conical crusher which is designed to achieve high yields of aggregate type material while minimizing waste material.

Another object of the present invention is to provide a conical crusher in which feed material flows generally uniformly through the crusher cavity to promote interparticle comminution and improve the shape of the discharged particles.

Still another object of the present invention is to provide a conical crusher in which the crushing surfaces of the head mantle and the bowl liner are configured for maximization of yield and minimization of waste despite the erosion of the crushing surfaces.

SUMMARY OF THE INVENTION

Accordingly, the conical crusher of the invention provides a crushing cavity in which the opposing crushing surfaces of the head mantle and the bowl liner are provided with specified shapes for the maximization of yield and minimization of waste. More specifically, the crushing surfaces of the mantle and bowl liner are each provided with a uniform radius of curvature, with the radius of curvature of the head mantle being distinct from the radius of curvature of the bowl liner. The uniform nature of the curvature of these opposing surfaces allows for a smoother passage, and more progressive reduction, of feed material through the crushing cavity in order to minimize waste. The improved flow characteristics provide a situation which promotes a uniform wear pattern through the life of the mantle and the liner.

DESCRIPTION OF THE PREFERRED EMBODIMENT

Figures 1, 2, 2A:
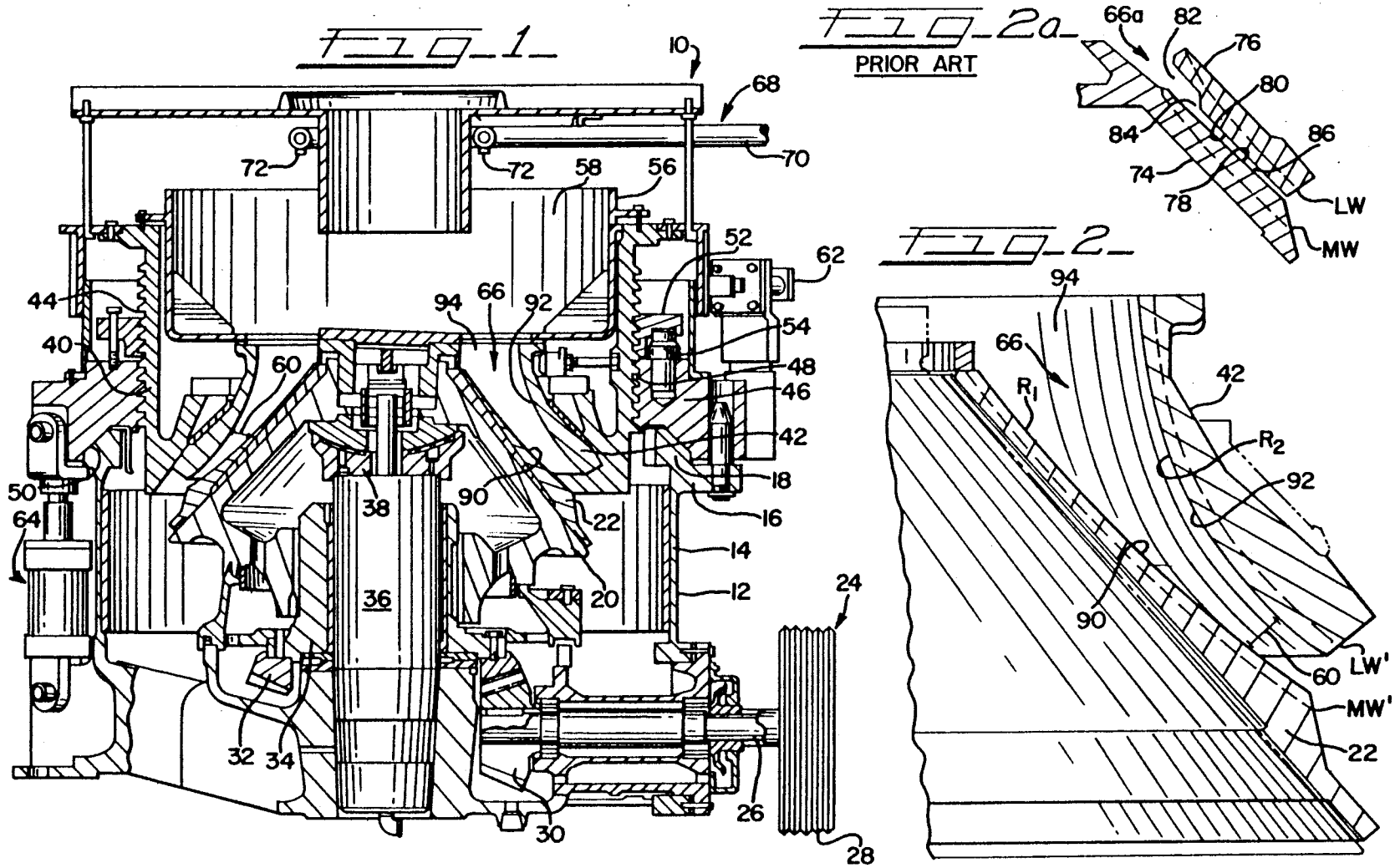
FIG. 2a PRIOR ART
FIG. 1 is a vertical sectional elevation of a conical crusher modified according to the teachings of the present invention.
FIG. 2 is a partial vertical sectional elevation of the crusher of FIG. 1 in which the opposing surfaces of the head mantle and the bowl liner are depicted in greater detail.
FIG. 2*a* is a partial vertical sectional elevation of the opposing crushing surfaces of a prior art head mantle and bowl liner.

The present invention pertains to conical crushers, the details of which are generally known in the art and are specifically described in commonly assigned U.S. Pat. No. 4,671,464 to Karra et al. issued June 9, 1987, the contents of which are incorporated by reference herein. Although U.S. Pat. No. 4,671,464 and the present application depict a specific type of conical crusher, that of a conical head driven by an eccentric for gyration about a fixed shaft, other operational configurations of conical crushers are contemplated, including, but not restricted to, hydraulic support cone crushers of the type having the head support shaft being vertically adjustable, as well as inertia cone crushers incorporating an out-of-balance flywheel weight with a ball and socket type drive transmission.

The present crusher, designated generally 10, includes a generally fixed mainframe housing 12 having a vertically projecting annular wall 14, the upper margin of which is provided with a thickened portion 16 with an angled surface 18 designated as a ring seat. A conical head 20 is provided with a detachable outer mantle 22 having a frusto-conical shape with a generally concave outer surface, and being fabricated of a wear-resistant material such as manganese alloy. The head 20 is located within the housing 12 and is connected to a drive system, partially shown and designated generally as 24, to effect a gyrational movement of the head within the housing. In the preferred embodiment, the drive system 24 includes a countershaft 26 journalled for low friction axial rotation in the housing 12. The countershaft 26 has a pulley 28 at one end and a pinion gear 30 at the opposite end. The pulley 28 is belt driven by an electric motor (not shown), and the pinion gear 30 meshes with a gear 32 integral with an eccentric 34. The eccentric 34 circumscribes and rotates about a fixed main shaft 36 having a spherical bearing 38 at its upper end. Operation of the drive system 24 causes the head 20 to gyrate about the main shaft 36.

The head 20 gyrates within an upper portion of the crusher 10 including a bowl 40. The bowl 40 is provided with a replaceable bowl liner 42 defining a negative concave crushing area having a generally convex surface. As is the case with the head mantle 22, the bowl liner 42 is preferably fabricated of wear-resistant material such as manganese alloy. However, the use of bowl liners 42 fabricated of other materials, such as, but not restricted to, bimetallics and plastics, is also contemplated. The bowl 40 has an annular configuration, the outer surface 44 of which is helically threaded to permit vertical adjustment of the bowl relative to the mainframe 12. An adjustment ring 46 may be disposed around the outer periphery of the bowl 40 and is also provided with inwardly projecting threads 48 which engage the threaded exterior 44 of the bowl. The adjustment ring 46 has a lower surface 50 which, in the present embodiment, is beveled to complement the angled ring seat surface 18 of the housing 12.

A clamping ring 52 may be disposed above the adjustment ring 46 and is also helically threaded on an interior surface so as to be threadably engaged to the outer surface of the bowl 40. At least one pressure cylinder 54 is provided to exert a locking force upon the upper surface of the adjustment ring 46. The upper portion 56 of the bowl 40 is configured to form a hopper 58 into which feed material is introduced.

Prior to operation, the crusher 10 is adjusted to have a specified setting or gap 60 between the head mantle 22 and the bowl liner 42. The setting 60 is measured at the narrowest point on the gyrational cycle of the head mantle 22 within the bowl liner 42. The setting is adjusted by releasing the clamping cylinders 54 on the locking ring 52 and rotating the bowl 26 using an adjustment mechanism 62 until a desired gap 60 is obtained. The setting 60 is secured by repressurizing the clamping cylinders 54. Generally, the narrower the setting 60, the finer the resulting crushed product.

Conventional conical crushers normally have some sort of mechanism for facilitating the rapid passage of tramp material, such as tramp iron and/or agglomerated fine particles, and such apparatus normally either takes the form of a plurality of hydraulic tramp release cylinders 64 or alternatively, coiled tramp release springs (not shown). During normal operation, the cylinders 64 are pressurized so as to hold the adjustment ring 46 and the bowl 40 against the frame 12.

When a piece of noncrushable tramp material becomes lodged in a crushing cavity, designated generally 66, the head 20 will exert sufficient upward force against the bowl 40 through the tramp material to overcome the force exerted by the tramp release cylinders 64. Once a predesignated pressure level is exceeded, pressurized hydraulic fluid is allowed to escape from the cylinder 64 to permit the bowl 40 to momentarily rise vertically. Thus, the bowl 40 is lifted to temporarily widen the setting 60 and allow the passage of the tramp material without damaging the crusher 10.

If desired, a water supply apparatus 68 may be disposed generally above the head 20 and the bowl 40. The apparatus 68 is basically a conduit 70 provided with a plurality of nozzles 72 which each direct a stream of water into the crushing cavity 66 of the crusher 10. The water injected into the cavity 66 by the apparatus 68 moistens the head mantle 22 and the bowl liner 42. A buildup of fines in the crushing cavity 66 may thus be prevented. Such an apparatus is described in greater detail in U.S. Pat. No. 4,671,474.

Referring now to FIG. 2*a*, the respective cross-sectional configurations of a conventional head mantle 74 and a conventional bowl liner 76 are illustrated. Respective crushing surfaces 78 and 80 of the mantle 74 and the liner 76 are dimensioned to be generally parallel to each other, so that as the crushing surfaces erode through use, the distance between the mantle 74 and the bowl liner 76 at a cavity entry area 82 will be generally reduced. The phantom line MW indicates the final profile of the head mantle 74 after erosion or wear, and the phantom line LW indicates the final profile of the liner 76 after erosion or wear.

A lower end of the cavity entry area 82 is defined at a point 84 where the crushing cavity 66*a* narrows. In operation, feed material introduced into the cavity 66*a* fills the cavity entry area 82, since much of the feed material is too large to pass the point 84. As the head mantle 74 gyrates against the liner 76, the feed material at the point 84 in the cavity entry area 82, and at a lower parallel zone 86 is comminuted between the mantle and liner until the material is of a small enough size to pass through the narrower lower parallel zone 86 of the crushing cavity 66*a*.

It has been found that the comminution which occurs in the lower parallel zone 86 creates a significant proportion of fines, which, when aggregate material is desired, is considered waste material. Aside from having little, if any, commercial value, this waste material is difficult to dispose of, and when it is stored in piles, may create a health and/or environmental hazard. In addition, depending on the setting of the crusher, the amount of waste material may reduce the overall production of the machine.

Another disadvantage of the configuration of the prior art mantle 74 and liner 76 is that upon reaching the wear lines MW and LW, the cavity entry area 82 will become closed off during part of each gyrational cycle of the mantle 74. This results in an interruption in the flow of material through the crusher, and reduces overall crusher production. Furthermore, tests have shown that the gap between the mantle 74 and the liner 76 narrows somewhat upon reaching the respective wear profiles MW, LW. Thus, through wear, the size of particles accepted into the cavity 66*a* is reduced.

Referring now to FIG. 2, the head mantle 22 and the bowl liner 42 of the invention are designed to address the above-identified problems of waste and low production of conventional crushers in aggregate-producing applications. This is accomplished by providing a generally concave shaped crushing surface 90 of the head mantle 22 with a constant radius of curvature R1 throughout its length. In addition, a generally convex shaped crushing surface 92 of the bowl liner 42 is provided with a constant radius of curvature R2 throughout its length.

Another feature of the present invention is the fact that the radius of curvature R1 of the head mantle 22 is distinct from the radius of curvature R2 of the bowl liner 42. In the preferred embodiment, the radius R1 is greater than the radius R2, and the radii R1 and R2 are nonconcentric. In other words, there is not a constant distance between the surface 90 and the surface 92. Thus, the narrowed point 84 and the lower parallel zone 86 (best seen in FIG. 2*a*) have been eliminated. Feed material will now flow smoothly through the crushing cavity 66 without being backed up and over-comminuted as described above in relation to the prior art crushing cavity 66*a*.

The configuration of the present head mantle 22 and the bowl liner 42 are such that through use, the relative positions of the corresponding crushing surfaces 90 and 92 will remain constant. This relationship is indicated by the phantom line MW', which indicates the final profile of the mantle 22 after wear, and the phantom line LW', which indicates the final profile of the liner 42 after wear. Since the radial relationship between the crushing surfaces 90 and 92 remains constant through use, even after the bowl position is adjusted to maintain a constant crusher setting 60, the present configuration should not be susceptible to the problem of feed cut-off which is commonplace with conventional crushing cavity configurations.

In other words, the present head mantle 22 and bowl liner 42 maintain a spatial relationship without any parallel zones as are found in conventional crushers. Instead, the present mantle 22 and liner 42 define a continuously curved "chute" which promotes the even comminution of material through the crusher cavity, while minimizing the generation of fines.

In operation, the head mantle 22 and the bowl liner 42 of the present invention define a crushing cavity 66 in which the feed material is introduced into a cavity entry area 94 at the upper end of the cavity 66 which is generally larger than the respective conventional area 82 due to the relative curvatures R1 and R2. Thus, the cavity 66 is maintained in a full condition from the area 94 to a lower end 96 of the cavity. This allows the crushing to be performed on a layer of material or bed of material throughout the length of the cavity 66.

It has been found that the use of the present head mantle and bowl liner configurations tends to improve cubical shape of the crushed particles. Also, the profiles of the present mantle 22 and liner 42 are such that, in the course of reaching a final wear profile is reached, a constant relationship between the surfaces 90 and 92 is maintained. Thus, a disruption in the flow of material is prevented. Consequently, less fines are produced, as the feed material is gradually comminuted until it is sufficiently reduced to pass through the setting 60 at the lower end 96 of the cavity 66 and ultimately exits the crusher 10.

While a particular embodiment of the conical crusher of the invention has been shown and described, it will be appreciated by those skilled in the art that changes and modifications may be made thereto without departing from the invention in its broader aspects and as set forth in the following claims.

What is claimed is:

1. In a conical crusher including a lower frame and an upper frame, the lower frame defining a space in which a conical head is caused to gyrate, the upper frame including a releasably fixed bowl disposed relative to the conical head to define a crushing cavity, the improvement comprising:

a head mantle configured for releasable attachment to the conical head, said head mantle having a crushing surface with a constant radius of curvature;

a bowl liner configured for releasable attachment to the bowl, said bowl liner having a crushing surface with a constant radius of curvature throughout its length;

said radius of curvature of said head mantle crushing surface being greater than said radius of curvature of said bowl liner crushing surface so that the crushing cavity does not have a parallel zone.

2. The crusher as defined in claim 1 in which said radius of curvature of said head mantle crushing surface is nonconcentric with said radius of curvature of said bowl liner crushing surface.

3. A head mantle for use with a conical crusher having a lower frame and an upper frame, the lower frame defining a space in which a conical head is caused to gyrate, the upper frame including a releasably fixed bowl disposed relative to the conical head to define a crushing cavity, the crusher including a bowl liner having a convex shaped crushing surface with a constant radius of curvature, said head mantle comprising: a concave shaped crushing surface with a constant radius of curvature throughout its length which is distinct form and larger than the radius of curvature of the bowl liner crushing surface.

4. The head mantle as defined in claim 3 wherein said radius of curvature of said head mantle is nonconcentric with the radius of curvature of the bowl liner.

5. A bowl liner for use with a conical crusher having a lower frame and an upper frame, the lower frame defining a space in which a conical head is caused to gyrate, the upper frame including a releasably fixed bowl disposed relative to the conical head to define a crushing cavity, the crusher head including a conical head mantle having a concave shaped crushing surface with a constant radius of curvature, said bowl liner comprising: a convex shaped crushing surface with a constant radius of curvature throughout its length which is distinct form, and smaller than the radius of curvature of said head mantle crushing surface.

6. The bowl liner as defined in claim 5 wherein said radius of curvature of said bowl liner is nonconcentric with the radius of curvature of the head mantle.

* * * * *